United States Patent [19]

Abe et al.

[11] Patent Number: 4,839,334

[45] Date of Patent: Jun. 13, 1989

[54] HEAT SENSITIVE RECORDING SHEET

[75] Inventors: Toshiyuki Abe; Katsumasa Kikkawa; Michihiro Gonda; Hideyuki Sensui; Mikiko Kanasugi, all of Tokyo, Japan

[73] Assignee: Hodogaya Chemical Co, Ltd., Tokyo, Japan

[21] Appl. No.: 2,235

[22] Filed: Jan. 12, 1987

[51] Int. Cl.[4] ..... B41M 5/18

[52] U.S. Cl. ..... 503/221; 427/151; 428/913; 503/204

[58] Field of Search ..... 427/150–152; 503/217, 221, 204; 549/226; 428/913, 195

[56] References Cited

U.S. PATENT DOCUMENTS 4,597,795 7/1986 Sensui et al. ..... 503/221

FOREIGN PATENT DOCUMENTS 0130086 6/1986 Japan ..... 503/221

*Primary Examiner*—Bruce H. Hess

*Attorney, Agent, or Firm*—Oblon, Spivak, McClelland, Maier & Neustadt

[57] ABSTRACT

A heat sensitive recording sheet having a heat sensitive color forming layer wherein a mixture of fluoran compounds of the following formulas I and II is used as a color former;

(I)

wherein $R_1$ is a hydrogen atom, an alkyl group having from 1 to 8 carbon atoms, a tetrahydrofurfuryl group, a substituted or unsubstituted phenyl group or a cycloalkyl group, $R_2$ is a hydrogen atom, a chlorine atom, a fluorine atom, a lower alkyl group, a lower alkoxy group, a lower alkoxyalkyl group, a phenyl group or a benzyl group, and $R_3$ is a hydrogen atom, a chlorine atom, a fluorine atom, a bromine atom, a lower alkyl group or an acyl group; and (II)

wherein each of $R_4$ and $R_5$ is a hydrogen atom, an alkyl group having from 1 to 8 carbon atoms, a substituted or unsubstituted phenyl group or a cycloalkyl group, or $R^4$ and $R_5$ may, together with the adjacent nitrogen atom, form a ring of the formula each of $R_6$ and $R_7$ is a hydrogen atom, a chlorine atom, a fluorine atom, a bromine atom, a lower alkyl group, a lower alkoxy group, a lower alkoxyalkyl group, a phenyl group or a benzyl group, and $R_8$ is a hydrogen atom, a chlorine atom, a fluorine atom, a bromine atom, a lower alkyl group or an acyl group.

3 Claims, No Drawings

HEAT SENSITIVE RECORDING SHEET

BACKGROUND OF THE INVENTION

1. Field of the Invention

The present invention relates to a heat sensitive recording sheet having excellent color forming properties, whereby the color images formed are stable against humidity in the room and against stains with oil, fats, etc.

2. Discussion of the Background

Heat sensitive recording sheets are recording sheets having a structure in which a so-called heat sensitive color forming layer capable of forming a color when heated, is formed on a substrate such as paper or the like. A thermal printer internally equipped with a thermal head may be employed for the heating for color forming. Recording sheets having such a structure wherein a heat sensitive color forming layer is provided, are widely used for facsimile printers, etc. for their advantages over other types of recording sheets in that they are inexpensive, they produce less noise, and the recording can thereby be completed in a short period of time. For heat sensitive recording sheets, it is most important that the color forming sensitivity is excellent. In recent years, they have been used also for display labels for POS (point of sale) and have been used in a wide range of fields. For the purpose of improving the basic properties of heat sensitive recording sheets, such as ability to produce sharp color images at high speed, the maintenance of the color images, the minimum initial color development, etc., studies have been made to employ various fluoran compounds as electron donative color formers, and various proposals have been made. However, the results so far obtained are not necessarily satisfactory.

In such heat sensitive recording sheets, it has been known to use a mixture of two or more color formers, for example, in Japanese Unexamined Patent Publications No. 109454/1979, No. 123085/1982 and No. 71192/1983. However, in these cases, heat sensitive recording sheets satisfying both requirements of the maintenance of the color images and the minimum initial color development, have not been obtained due to the nature of the color formers used. Namely, in a heat sensitive recording sheet in which color formers having good fastness against the fading of color images in an environment of heat, humidity, oils, plasticizers or lights, are used in combination as a mixture, the initial color development in the same environment will be unduly high. On the other hand, in a heat sensitive recording sheet in which color formers having minimum initial color development are used in combination as a mixture, the color images obtained, tend to fade away. Further, in a case where a color former having minimum initial color development and a color former having high initial color development are used in combination, the initial color development will be pronounced, such being practically undesirable.

SUMMARY OF THE INVENTION

The present inventors have conducted extensive research with an aim to develop a heat sensitive recording sheet which has well balanced properties and which has minimum fading of the color images and minimum initial color development even under an adverse environmental condition such as heat, humidity, oils, plasticizers, etc. As a result, the present invention has been accomplished.

The present invention provides a heat sensitive recording sheet having a heat sensitive color forming layer wherein a mixture of fluoran compounds of the following formulas I and II is used as a color former:

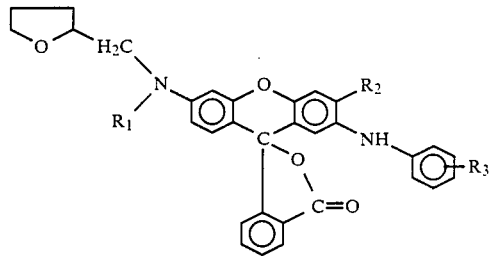

wherein $R_1$ is a hydrogen atom, an alkyl group having from 1 to 8 carbon atoms, a tetrahydrofurfuryl group, a substituted or unsubstituted phenyl group or a cycloalkyl group, $R_2$ is a hydrogen atom, a chlorine atom, a fluorine atom, a lower alkyl group, a lower alkoxy group, a lower alkoxyalkyl group, a phenyl group or a benzyl group, and $R_3$ is a hydrogen atom, a chlorine atom, a fluorine atom, a bromine atom, a lower alkyl group or an acyl group; and

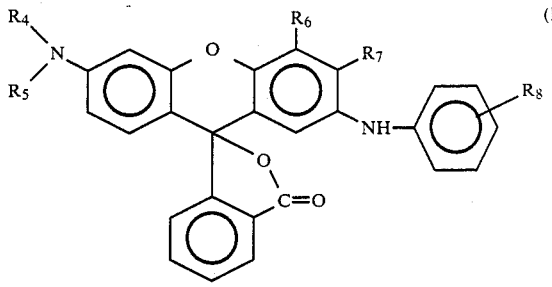

wherein each of $R_4$ and $R_5$ is a hydrogen atom, an alkyl group having from 1 to 8 carbon atoms, a substituted or unsubstituted phenyl group or a cycloalkyl group, or $R_4$ and $R_5$ may, together with the adjacent nitrogen atom, form a ring of the formula

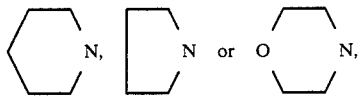

each of $R_6$ and $R_7$ is a hydrogen atom, a chlorine atom, a fluorine atom, a bromine atom, a lower alkyl group, a lower alkoxy group, a lower alkoxyalkyl group, a phenyl group or a benzyl group, and $R_8$ is a hydrogen atom, a chlorine atom, a fluorine atom, a bromine atom, a lower alkyl group or an acyl group.

DETAILED DESCRIPTION OF THE PREFERRED EMBODIMENTS

Now, the present invention will be described in detail with reference to the preferred embodiments.

Representative examples of the fluoran compounds of the formula I used for the color former in the heat sensitive recording sheet of the present invention, are shown in Table 1. However, the useful fluoran compounds are not limited to these specific examples.

TABLE 1

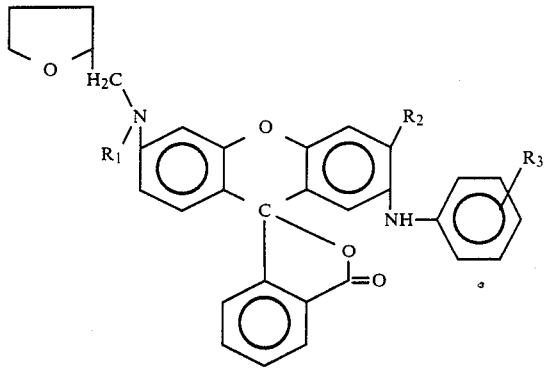

| Compound No. | $R_1$ | $R_2$ | $R_3$ |
|---|---|---|---|
| 1 | $C_2H_5$ | $CH_3$ | H |
| 2 | $CH_3$ | $CH_3$ | H |
| 3 | $C_3H_7$ | $CH_3$ | H |
| 4 | $C_4H_9$ | $CH_3$ | H |
| 5 | $CH_3$ | H | O—Cl |
| 6 | $C_2H_5$ | H | o-Cl |
| 7 | $CH_3$ | Cl | H |
| 8 | $CH_3$ | 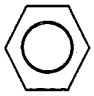 | H |
| 9 | $C_2H_5$ | $OCH_3$ | o-Cl |
| 10 | $CH_3$ | 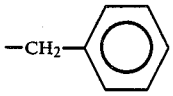 | H |
| 11 | 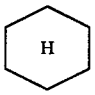 | $CH_3$ | H |

TABLE 1-continued

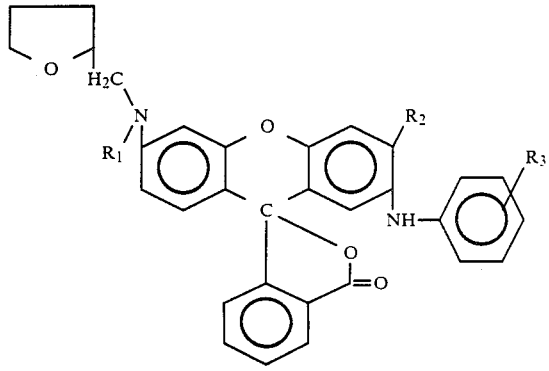

| Compound No. | $R_1$ | $R_2$ | $R_3$ |
|---|---|---|---|
| 12 | 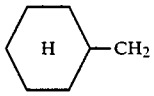 | $CH_3$ | o-Cl |
| 13 | 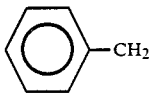 | $CH_3$ | H |
| 14 | 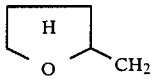 | $CH_3$ | H |
| 15 | $CH_3$ | $CH_3$ | p-Cl |

Representative examples of the fluoran compounds of the formula II used for the color former in the heat sensitive recording sheet of the present invention, are shown in Table 2. However, useful fluoran compounds are not limited to such specific examples.

TABLE 2

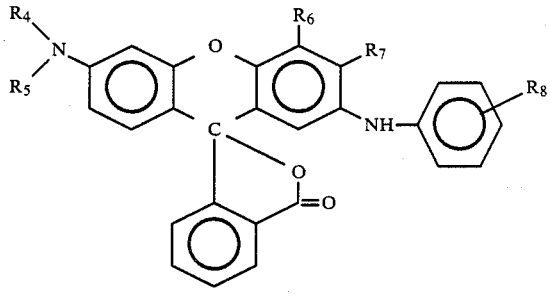

| Compound No. | $R_4$ | $R_5$ | $R_6$ | $R_7$ | $R_8$ |
|---|---|---|---|---|---|
| 16 | $CH_3$ | $C_2H_5$ | H | $CH_3$ | H |
| 17 | $C_2H_5$ | $C_2H_5$ | H | $CH_3$ | H |
| 18 | $CH_3$ | i-$C_3H_7$ | H | $CH_3$ | H |
| 19 | n$C_4H_9$ | n$C_4H_9$ | H | $CH_3$ | H |
| 20 | $C_2H_5$ | $C_2H_5$ | H | H | o-Cl |
| 21 | $C_2H_5$ | $C_2H_5$ | H | H | o-F |
| 22 | n$C_4H_9$ | n$C_4H_9$ | H | H | o-Cl |
| 23 | $C_2H_5$ | $C_2H_5$ | H | Cl | H |

TABLE 2-continued
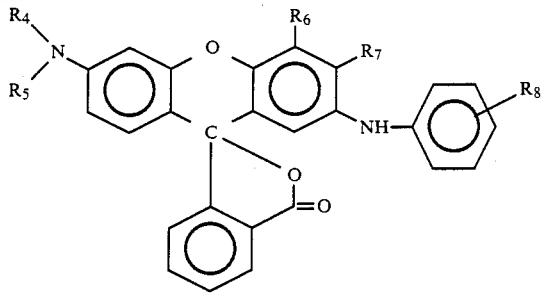
| Compound No. | $R_4$ | $R_5$ | $R_6$ | $R_7$ | $R_8$ |
|---|---|---|---|---|---|
| 24 | $CH_3$ | 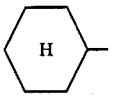 | H | $CH_3$ | H |
| 25 | $C_2H_5$ | i-$C_5H_{11}$ | H | $CH_3$ | H |
| 26 | $C_2H_5$ | 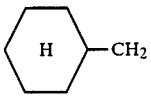 | H | $CH_3$ | H |
| 27 | $C_2H_5$ | $C_2H_5$ | $CH_3$ | $CH_3$ | H |
| 28 | $C_2H_5$ | n-$C_6H_{13}$ | H | H | o-Cl |
| 29 | $C_2H_5$ | 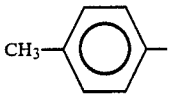 | H | $CH_3$ | H |
| 30 | $nC_4H_9$ | $nC_4H_9$ | H | $-oCH_3$ | H |
| 31 | $nC_4H_9$ | $nC_4H_9$ | H | 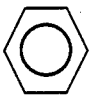 | o-Cl |
| 32 | $CH_3$ | 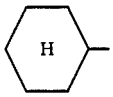 | H | 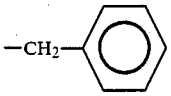 | H |
| 33 | $C_2H_5$ | i-$C_5H_{11}$ | H | 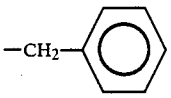 | H |
| 34 | $nC_4H_9$ | $nC_4H_9$ | H | $-Cl$ | H |
| 35 | $C_2H_5$ | $C_2H_5$ | H | $-CH_3$ | p-$nC_4H_9$ |
| 36 | $C_2H_5$ | 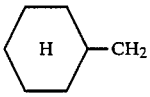 | H | H | o-Cl |
| 37 | $C_2H_5$ | $C_2H_5$ | H | H | p-$COCH_3$ |
| 38 | | 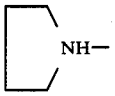 | H | $CH_3$ | H |
| 39 | | 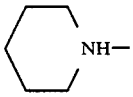 | H | $CH_3$ | H |

TABLE 2-continued

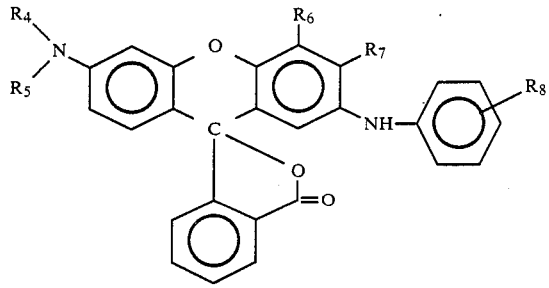

| Compound No. | $R_4$ | $R_5$ | $R_6$ | $R_7$ | $R_8$ |
|---|---|---|---|---|---|
| 40 | | 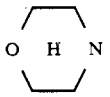 | H | H | Cl |

Now, the heat sensitive recording sheet of the present invention will be described in detail. The heat sensitive recording sheet of the present invention may be prepared as follows.

A mixture comprising the fluoran compounds of the formulas I and II and an acidic substance is dispersed by using usually water as a medium by means of e.g. a ballmill, an attritor, a red devil or a Dyno mill, and mixed to obtain a coating composition. The coating composition is then coated on a substrate sheet and dried to obtain the heat sensitive recording sheet. The proportions of the compounds of the formulas I and II in the mixture used for the heat sensitive color forming layer in the heat sensitive recording sheet of the present invention are within a range of from 3:97 to 97:3, preferably from 30:70 to 70:30, by weight.

The fluoran compounds of the formulas I and II may be preliminarily melt-mixed together prior to the use, or may be formulated into coating solutions, respectively, and then mixed together for use.

The acidic substance used as a developer for the color forming of the fluoran compounds of the formulas I and II of the present invention, may be conventional acidic substances such as 2,2-bis(4-hydroxydiphenyl)propane, 4-t-butylphenol, 4-phenylphenol, methyl-4-hydroxybenzoate, 4,4'-isopropylidene-bis(2,6-dibromophenol), bis(4-hydroxyphenyl)sulfone, benzyl p-hydroxybenzoate, sec-butyl p-hydroxybenzoate or 3-(α-methylbenzyl)salicylate. These acidic substances may be used alone or in combination as a mixture of two or more different kinds.

Further, a binder is used for binding the fluoran compounds of the formulas I and II and the acidic substance to the substrate sheet. Representative binders include polyvinyl alcohol, methyl cellulose, hydroxyethyl cellulose, carboxymethyl cellulose, gum arabic, starch, gelatin, casein, polyvinyl pyrrolidone and a styrene-maleic anhydride copolymer. The binder preferably employed in the present invention is a water-soluble binder. The typical example is polyvinyl alcohol (PVA).

Further, various other additives may be incorporated into the recording sheet of the present invention. For example, there may be mentioned a dispersing agent such as sodium dodecylbenzenesulfonate or a metal salt of a fatty acid, an ultraviolet absorbing agent of a benzophenone type or a triazole type, and a sensitizing agent such as dimethyl terephthalate, dibenzyl terephthalate, β-naphthol benzyl ether, stearic amide or benzyl p-benzyloxybenzoate.

To avoid the sticking of the heat sensitive recording sheet upon contact with a thermal head or with a recording device, it is possible to incorporate a wax, zinc stearate or calcium stearate to the heat sensitive recording sheet. Further, a pigment having a high oil absorption value may be added to minimize dust deposition on the thermal head.

The substrate sheet may be a paper sheet, a plastic film, a synthetic paper or a woven fabric sheet. However, paper is preferably employed from the viewpoint of the costs and the physical properties.

The coating amount on the substrate sheet is not critical, but usually within a range of from 2 to 12 g/m$^2$, preferably from 3 to 10 g/m$^2$, by dry weight.

Now, the present invention will be described with reference to Examples. However, it should be understood that the present invention is by no means restricted to such specific Examples. In the Examples, "parts" and "%" mean "parts by weight" and "% by weight", respectively.

EXAMPLE 1

Mixtures having the following compositions were separately pulverized to a particle size of from 2 to 3 μm by means of a Dyno mill (wet system dispersing machine) to obtain a color former dispersion, a developer dispersion and an additive dispersion.

| | | |
|---|---|---|
| (A) | Composition of the color former dispersion | |
| | Compound No. 1 identified in Table 1 | 2 parts |
| | Compound No. 22 identified in Table 2 | 2 parts |
| | 10% of PVA | 30 parts |
| | Water | 6 parts |
| (B) | Composition of the developer dispersion | |
| | 2,2-bis(4-hydroxydiphenyl propane) | 10 parts |
| | 10% PVA | 15 parts |
| | Water | 55 parts |
| (C) | Composition of the additive dispersion | |
| | Calcium carbonate | 10 parts |
| | Stearic amide | 4 parts |
| | Zinc stearate | 2 parts |
| | 10% PVA | 15 parts |
| | Water | 49 parts |

Dispersions (A), (B) and (C) were mixed in a weight ratio of 2:4:4 to obtain a coating composition for a heat sensitive recording sheet.

This coating composition was applied onto the surface of a normal paper by means of a wire bar coater in such an amount that the dry weight of the coated composition after drying would be 6.5 g/m$^2$, followed by drying at room temperature in an air-circulating dryer to obtain a heat sensitive recording sheet (a) of the present invention.

EXAMPLE 2

Heat sensitive recording sheets (b), (c) and (d) were obtained in the same manner as in Example 1 except that compounds No. 17, No. 19 and No. 24 were used instead of compound No. 22 in the composition of the dispersion (A).

EXAMPLE 3

A heat sensitive recording sheet (e) was obtained in the same manner as in Example 1 except that compound No. 2 was used instead of compound No. 1 in the composition of the dispersion (A).

EXAMPLE 4

Heat sensitive recording sheets (f) and (g) were obtained in the same manner as in Example 1 except that the proportions of compounds No. 1 and No. 22 in the composition of the dispersion (A) were varied as shown in Table 3.

The heat sensitive recording sheets of the present invention thus obtained, were tested for the sensitivity, the color fastness against humidity, the oil resistance and the plasticizer resistance. The results are shown in Table 3.

COMPARATIVE EXAMPLE 1

Comparative heat sensitive recording sheets (h), (i) and (j) were obtained in the same manner as in Example 1 except that compounds No. 17, No. 24 and No. 29 were used instead of compound No. 1 in the composition of the dispersion (A). Namely, in these recording sheets, fluoran compounds of the formula II were mixed together.

COMPARATIVE EXAMPLE 2

A heat sensitive recording sheet (k) was prepared in the same manner as in Example 1 except that compound No. 17 was used instead of compound No. 1 and compound No. 24 was used instead of compound No. 22 in the composition of the dispersion (A).

COMPARATIVE EXAMPLE 3

For the purpose of comparison, a color former dispersion having the following composition, was employed wherein one type of a fluoran compound of the formula I or II was used.

| (D) | Color fomer dispersion | |
|---|---|---|
| | A compound of the formula I or II | 4 parts |
| | 10% PVA | 30 parts |
| | Water | 6 parts |

By using the dispersions (B) and (C) as used in Example 1, the dispersions (D), (B) and (C) were mixed in a weight ratio of 2:4:4. Then, heat sensitive recording sheets (l) to (r) were prepared in the same manner as in Example 1.

COMPARATIVE EXAMPLE 4

For the purpose of comparison, fluoran compounds of the formula II were mixed in various proportions as identified in Table 3. Then, heat sensitive recording sheets (s), (t), (u), and (v) were obtained in the same manner as in Example 1.

The comparative heat sensitive recording sheets thus obtained were tested for their properties in the same manner as in Example 1. The results are also shown in Table 3.

TABLE 3

| | Heat sensitive recording sheet No. | Compound No. of the formula I | Compound No. of the formula II | Ratio of I/II (parts) | Color forming sensitivity (D) | Initial color density ($D_0$) | Color fastness against humidity ($D_1$) (%) | Resistance against initial color development under humidity ($D_2$) | Oil resistance ($D_3$) (%) | Plasticizer resistance ($D_4$) (%) |
|---|---|---|---|---|---|---|---|---|---|---|
| Example 1 | (a) | No. 1 | No. 22 | 0.5/0.5 | 1.27 | 0.18 | 93 | 0.26 | 62 | 69 |
| Example 2 | (b) | No. 1 | No. 17 | " | 1.26 | 0.21 | 94 | 0.28 | 74 | 82 |
| Example 2 | (c) | No. 1 | No. 19 | " | 1.27 | 0.20 | 94 | 0.28 | 77 | 84 |
| Example 2 | (d) | No. 1 | No. 24 | " | 1.22 | 0.23 | 102 | 0.38 | 91 | 91 |
| Example 3 | (e) | No. 2 | No. 22 | " | 1.27 | 0.19 | 96 | 0.30 | 78 | 76 |
| Example 4 | (f) | No. 1 | No. 22 | 0.75/0.25 | 1.24 | 0.14 | 96 | 0.26 | 72 | 78 |
| Example 4 | (g) | No. 1 | No. 22 | 0.25/0.75 | 1.14 | 0.19 | 84 | 0.19 | 60 | 67 |
| Comparative Example 1 | (h) | — | No. 22 No. 17 | —/0.5 + 0.5 | 1.01 | 0.27 | 42 | 0.30 | 26 | 26 |
| Comparative Example 1 | (i) | — | No. 22 No. 24 | —/0.5 + 0.5 | 1.04 | 0.26 | 44 | 0.25 | 24 | 22 |
| Comparative Example 1 | (j) | — | No. 22 No. 29 | —/0.5 + 0.5 | 1.06 | 0.18 | 47 | 0.24 | 30 | 28 |
| Comparative Example 2 | (k) | — | No. 17 No. 24 | —/0.5 + 0.5 | 1.14 | 0.42 | 74 | 0.43 | 69 | 80 |
| Comparative Example 3 | (l) | No. 1 | — | 1.0/— | 1.13 | 0.27 | 79 | 0.25 | 36 | 36 |
| Comparative Example 3 | (m) | No. 2 | — | 1.0/— | 1.04 | 0.29 | 93 | 0.41 | 63 | 64 |
| Comparative | (n) | — | No. 17 | —/1.0 | 1.14 | 0.34 | 85 | 0.32 | 41 | 41 |

TABLE 3-continued

| | Heat sensitive recording sheet No. | Compound No. of the formula I | Compound No. of the formula II | Ratio of I/II (parts) | Color forming sensitivity (D) | Initial color density ($D_0$) | Color fastness against humidity ($D_1$) (%) | Resistance against initial color development under humidity ($D_2$) | Oil resistance ($D_3$) (%) | Plasticizer resistance ($D_4$) (%) |
|---|---|---|---|---|---|---|---|---|---|---|
| Example 3 Comparative | (o) | — | No. 19 | —/1.0 | 1.18 | 0.29 | 82 | 0.28 | 32 | 40 |
| Example 3 Comparative | (p) | — | No. 22 | —/1.0 | 0.90 | 0.07 | 19 | 0.08 | 11 | 11 |
| Example 3 Comparative | (q) | — | No. 24 | —/1.0 | 1.16 | 0.30 | 81 | 0.26 | 29 | 25 |
| Example 3 Comparative | (r) | — | No. 25 | —/1.0 | 1.03 | 0.23 | 68 | 0.27 | 23 | 30 |
| Example 3 Comparative | (s) | — | No. 22 No. 24 | —/0.75 + 0.25 | 0.94 | 0.29 | 20 | 0.29 | 15 | 12 |
| Example 4 Comparative | (t) | — | No. 22 No. 24 | —/0.25 + 0.75 | 1.01 | 0.32 | 35 | 0.30 | 26 | 16 |
| Example 4 Comparative | (u) | — | No. 17 No. 24 | —/0.75 0.25 | 1.14 | 0.36 | 70 | 0.42 | 57 | 78 |
| Example 4 Comparative | (v) | — | No. 17 No. 24 | —/0.25 0.75 | 1.15 | 0.32 | 64 | 0.40 | 52 | 73 |
| Example 4 | | | | | | | | | | |

(Note 1) Color forming sensitivity (D): As the dynamic color forming condition, by using a thermal head printing device (manufactured by Matsushita Denshi Buhim K.K), solid black printing was conducted at a printing voltage of 14 V with a pulse width of 2.0 milliseconds, and the solid black portions were measured by a Macbeth reflection color density tester RD-514.

(Note 2) Initial color density ($D_0$): The initial color of the non-developed heat sensitive recording sheet.

(Note 3) Color fastness against humidity: This represents the color fastness against humidity after the color forming by heating. The portions (D) subjected to color forming at 14 V by the thermal head printing device, were left to stand in an atmosphere of 50° C. under a relative humidity of 90% for 24 hours, and then the color density ($D_1$) of the portions was measured, whereupon the color-remaining rate (%)$=D_1/D\times 100$ was obtained and used to represent the color fastness against humidity. $D_2$ represents the initial color density at that time.

(Note 4) Oil resistance: A 5% caster oil-chloroform solution was coated on a polyester film by means of a film applicator (20μ scale) and dried in air. Then, the caster oil on the film was stamped with a rubber stamp on the portions at which the color was formed by a thermal head printing device at 14 V, and the stamped recording sheet was left to stand in a constant temperature and constant humidity tester at 50° C. under a relative humidity of 90% for 3 hours. Then, the color density ($D_3$) was measured, and the color remaining rate (%)$=D_3/D\times 100$ was obtained and used to represent the oil resistance.

(Note 5) Plasticizer resistance: The portions at which the color was formed by a thermal head printing device at 14 V, were uniformly covered with Saran Wrap (wrapping film manufactured by Asahi Kasei K.K.) and kept under a load of 20 g/cm$^2$ at 50° C. for 24 hours. Then, the color density ($D_3$) was measured, and the color remaining rate (%)$=D_3/D\times 100$ was obtained and used to represent the plasticizer resistance.

As is evident from the results of Table 3, the heat sensitive recording sheets of the present invention have excellent color fastness against humidity, oil resistance and plasticizer resistance and little initial color development, and thus they are very well balanced heat sensitive recording sheets.

We claim:

1. A heat sensitive recording sheet having a heat sensitive color forming layer wherein a mixture of fluoran compounds of the following formulas I and II is used as a color former:

(I)

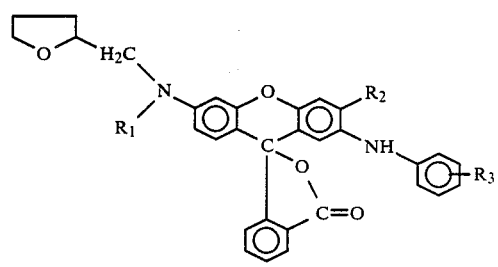

wherein $R_1$ is a hydrogen atom, an alkyl group having from 1 to 8 carbon atoms, a tetrahydrofurfuryl group, a substituted or unsubstituted phenyl group or a cycloalkyl group, $R_2$ is a hydrogen atom, a chlorine atom, a fluorine atom, a lower alkyl group, a lower alkoxy group, a lower alkoxyalkyl group, a phenyl group or a benzyl group, and $R_3$ is a hydrogen atom, a chlorine atom, a fluorine atom, a bromine atom, a lower alkyl group or an acyl group; and

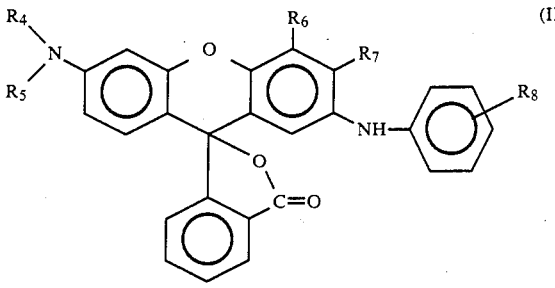

(II)

wherein each of $R_4$ and $R_5$ is a hydrogen atom, an alkyl group having from 1 to 8 carbon atoms, a substituted or unsubstituted phenyl group or a cycloalkyl group, or $R_4$ and $R_5$ may, together with the adjacent nitrogen atom, form a ring of the formula

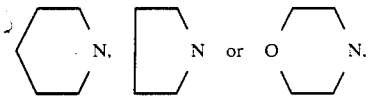

each of $R_6$ and $R_7$ is a hydrogen atom, a chlorine atom, a fluorine atom, a bromine atom, a lower alkyl group, a lower alkoxy group, a lower alkoxyalkyl group, a phenyl group or a benzyl group, and $R_8$ is a hydrogen atom, a chlorine atom, a fluorine atom, a bromine atom, a lower alkyl group or an acyl group.

2. The heat sensitive recording sheet according to claim 1, wherein the proportions of the compounds of the formulas I and II in the mixture are within a range of from 3:97 to 97:3 by weight.

3. The heat sensitive recording sheet according to claim 1, wherein the proportions of the compounds of the formulas I and II in the mixture are within a range of from 30:70 to 70:30.

* * * * *